US006135045A

United States Patent [19]

Staff

[11] Patent Number: 6,135,045

[45] Date of Patent: Oct. 24, 2000

[54] FLOATING PLATFORM

[76] Inventor: Edward C. Staff, 240 Chene St., Detroit, Mich. 48207

[21] Appl. No.: 09/299,753

[22] Filed: Apr. 27, 1999

[51] Int. Cl.[7] ..... B63B 35/44

[52] U.S. Cl. ..... 114/266; 441/34

[58] Field of Search ..... 114/264, 266, 114/267; 441/34, 129, 136

[56] References Cited

U.S. PATENT DOCUMENTS 1,107,652 8/1914 Burton .

3,694,837 10/1972 Von Norring .

3,789,446 2/1974 Rudelick .

4,733,626 3/1988 Svirklys et al. ..... 114/266

5,129,347 7/1992 Hill ..... 114/266

*Primary Examiner*—Jesus D. Sotelo

*Attorney, Agent, or Firm*—Charles W. Chandler

[57] ABSTRACT

This invention is related to rafts or floating platforms, and more particularly to a platform form of a plurality permanently buoyant panels that can be readily assembled or disassembled.

9 Claims, 4 Drawing Sheets

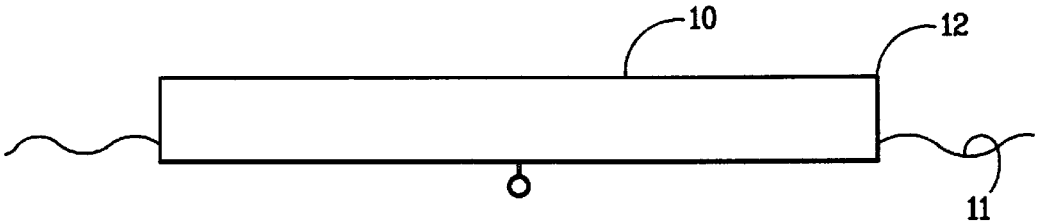
FIG. 1
FIG. 2
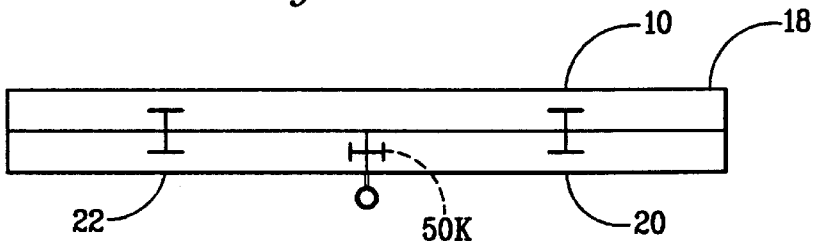
FIG. 3
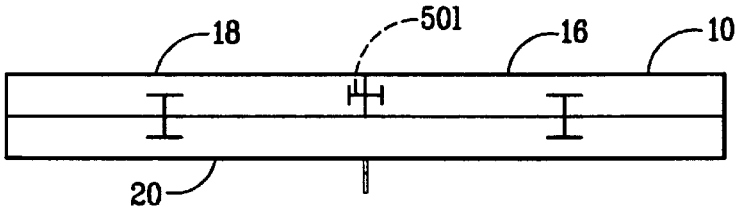
FIG. 4
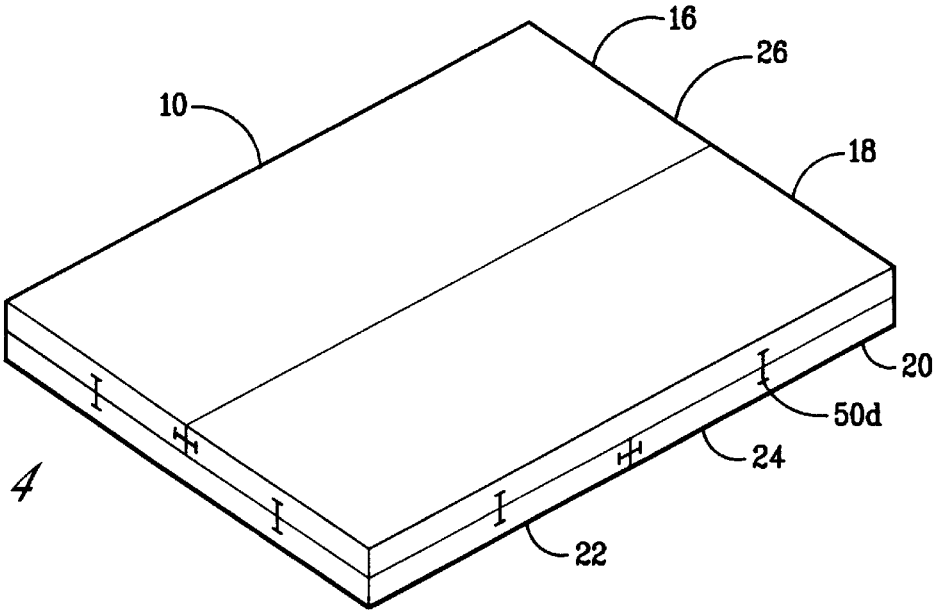

FLOATING PLATFORM

BACKGROUND OF THE INVENTION

This invention is related to floating platforms, and more particularly to a modular raft formed of similarly-shaped, closed cell foam panels.

Recreational floating platforms or rafts are commonly used for swimmers, bathers and others who like to sunbathe.

Examples of such rafts may be found in U.S. Pat. No. 1,107,652 issued to Oliver M. Burton, Aug. 18, 1914 for a Life Raft; U.S. Pat. No. 3,694,837 issued to Enar Sixten Von Norring, Oct. 3, 1972 for a Floating Body; and U.S. Pat. No. 3,789,446 issued to to John Rudelick for Unsinkable Raft. Generally such rafts are formed of several components that are joined together to form a permanently assembled raft.

A raft is desirable that can be inexpensively manufactured, has few components, can be easily assembled and disassembled, and when disassembled can be readily stored in a compact area.

SUMMARY OF THE INVENTION

The broad purpose of the present invention is to provide an improved raft formed of at least four foam panels that are connected together to form a floating platform having excellent buoyancy characteristics. A preferred platform has an eight-foot by eight-foot configuration. Four eight foot by four foot panels are joined by novel clamping hardware.

The preferred embodiment of the invention comprises two elongated top panels supported side-edge to side-edge, and a second pair of elongated bottom panels that are side-edge to side-edge and in face-to-face relationship with the top panels but at right angles to the top panels. An eyebolt and a pair of clamping plates join portions of all four panels between the two plates in the center of the platform. The eye of the bolt is beneath the bottom of the platform to provide anchoring hardware.

A system of outer clamping plates join the outer edges of the top and bottom layers of panels together.

The assembled platform can be readily moved with a small trailer into and out of the water, and provides a safe relatively large floating platform for bathers.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like p s throughout the several views, and in which:

FIG. 1 an elevational view of a platform illustrating the preferred embodiment of the invention, float water;

FIG. 2 is a of the platform as seen along lines 2—2 of FIG. 6;

FIG. 3 is a view taken along lines of 3—3 of FIG. 6;

FIG. 4 is a perspective view of the platform with the cover removed;

DESCRIPTION OF THE PREFERRED EMBODIMENT

Figure 5:
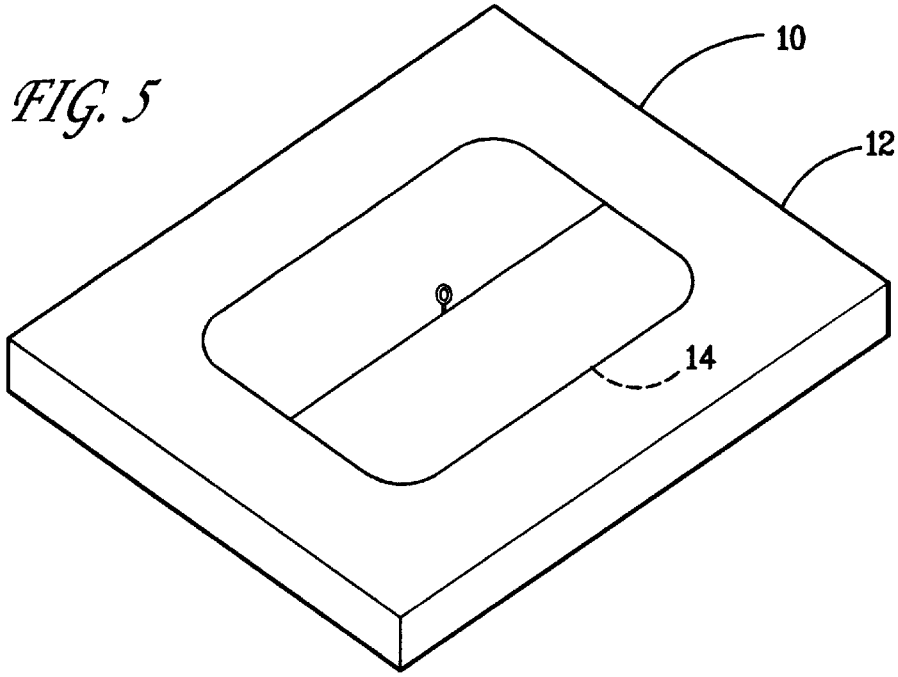
FIG. 5 is a view of the bottom of the preferred platform showing the eyebolt.

Referring to the drawings, a preferred platform 10 is illustrated in FIGS. 1, 4 and 5 floating in water 11. Platform 10 is preferably square, with 8 foot by 8-foot sides and about 8 inches thick. The platform has an outer fabric slip cover 12 with preformed corners. The bottom half of the slip cover is coated with a polyvinylchloride coating. The slip cover has an elastic band 14 sewn around the cover's open edge to form a snug fit around the platform panels.

Figure 6:
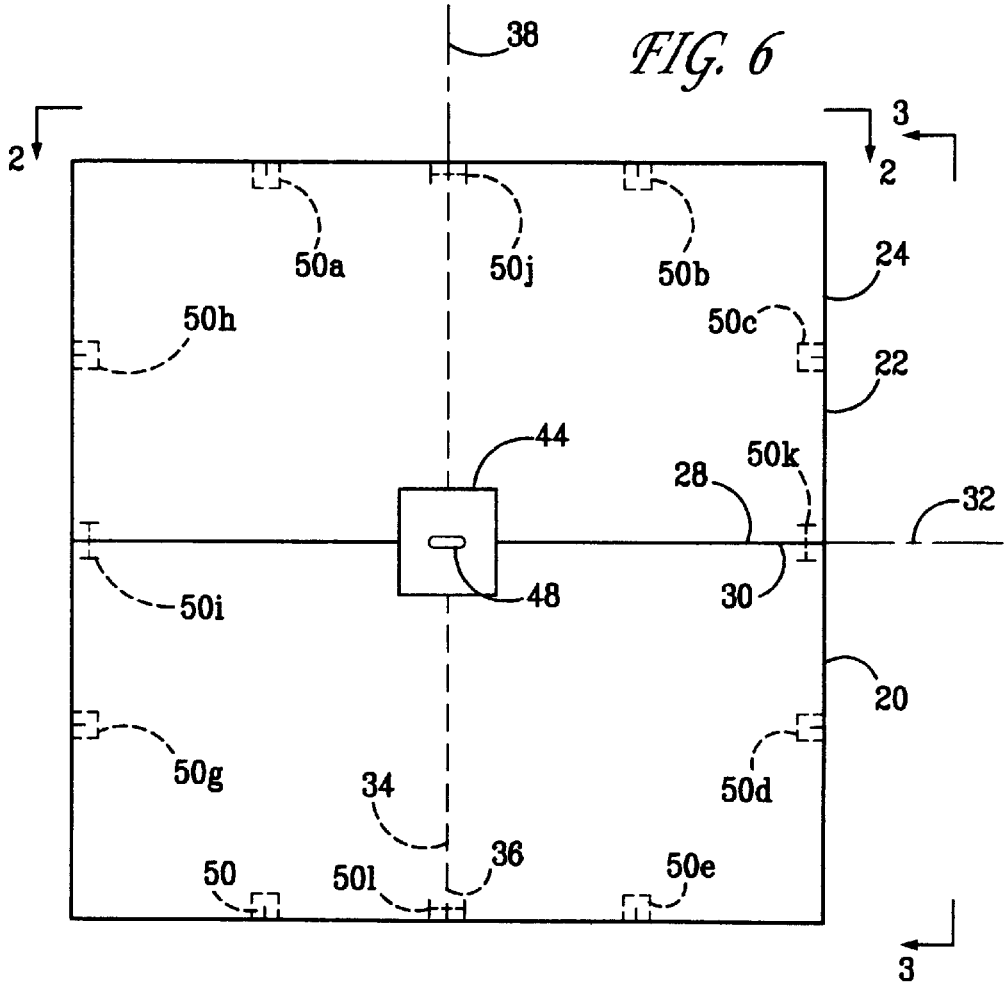
FIG. 6 is a sectional view illustrating the locations of the clamping plates.

Referring to FIGS. 2, 3, and 6, the platform preferably comprises four identically-shaped foam panels 16, 18, 20, and 22 each formed of a permanently buoyant, closed cell foam construction. Each panel is 48 inches wide, 96 inches long and about 4 inches thick. The panels are preferably made of a slightly resilient closed cell, elastic material marketed under the name POLYPLANK, and commonly used as a packaging material. It is dust free, odorless, nonabrasive, moisture resistant and solvent resistant. Other similar foam materials are available.

Referring to FIG. 6, the panels are arranged into what will be referred to as a lower panel layer 24 and upper panel layer 26. Lower panel 20 has an inner linear flat side edge 28, and lower panel 22 has a linear flat side edge 30 in abutment with side edge 28 along a plane generally indicated at 32. The upper panel layer includes panels 16 and 18 having flat linear side edges 34 and 36 in abutment along a plane generally indicated at 38. Planes 32 and 38 intersect at the center 40 of the platform.

Figure 9:
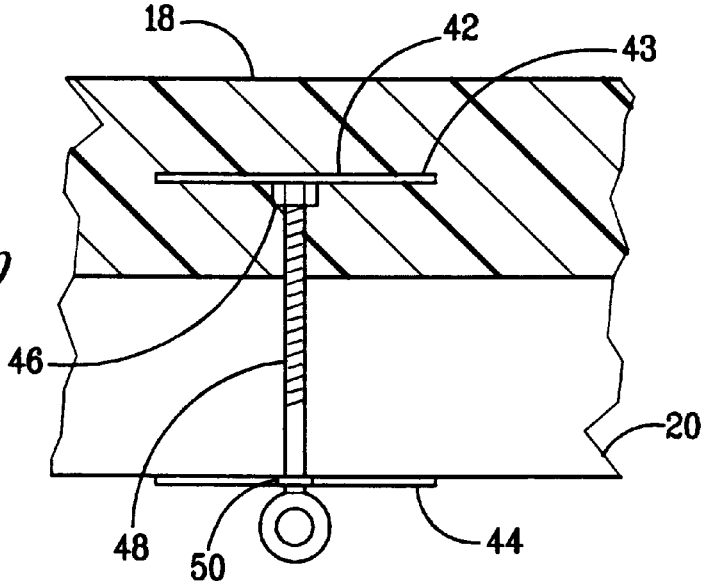
FIG. 9 an enlarged sectional view showing a clamping device used for connecting the pane e center of the platform.

Referring to FIGS. 6 and 9, the four panels are clamped together at center 40 by an upper clamping plate 42 and a lower clamping plate 44. Upper clamping plate 42 is inserted in preformed slots 43 (only one shown) formed in the opposed side edges of top panels 16 and 18 midway between their upper and lower parallel surfaces. The slots are about 6 inches deep and 12 inches long for receiving a quarter inch thick 12 inch by 12 inch square aluminum clamping plate 42.

Lower clamping plate 44 also is ¼ inch thick and 12 inch by 12 inch square. Plate 44 is mounted on the bottom surface of lower panels 20 and 22 such that the midsection of the abutting side edges of the four panels are sandwiched between the two clamping plates 42 and 44.

An aluminum nut 46 is mechanically attached to the lower side of plate 42. A six inch long eye bolt 48 is received through an opening 50 in the lower clamping plate and threadably attached to nut 46 to clamp the four panels together in the center of the platform. The eyebolt provides means for attaching an anchoring system. The length of the eyebolt is chosen so that it can be tightened each year to insure a tight fit with the four panels.

Figure 8:
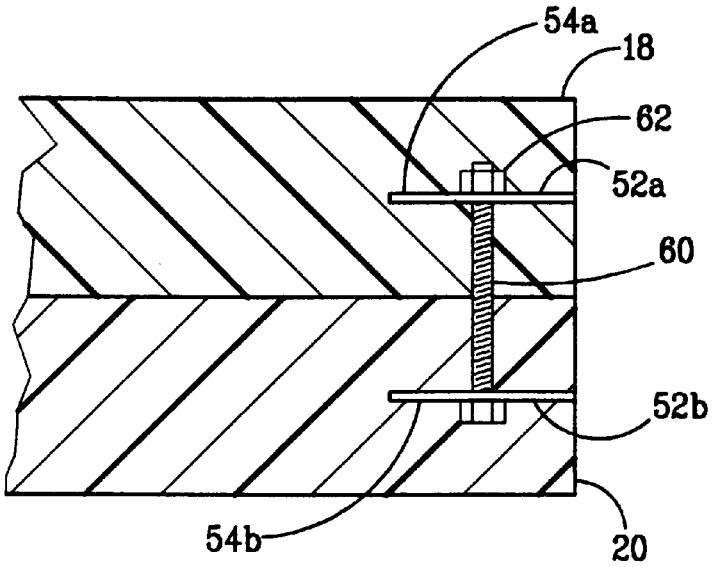
FIG. 8 is an enlarged sectional view of a typical clamping device used for connecting the outer side edges of the platform.

The outer side edges of each of the four panels are connected to the adjacent panel in eight locations, generally indicated in FIG. 6 at 50*a*, 50*b*, 50*c*, 50*d*, 50*e*, 50*f*, 50*g*, and 50*h*. A typical clamping device is illustrated in FIG. 8 for clamping the side edge of upper panel 18 to lower panel 20 at location 50*d*. The side edge of each panel at this location is formed with slots 52*a* and 52*b*, which are, disposed one above the other and in the center of the panel thickness. Identical plastic clamping plates 54*a* and 54*b* are inserted in the slots through the side edges of the panels.

Figure 7:
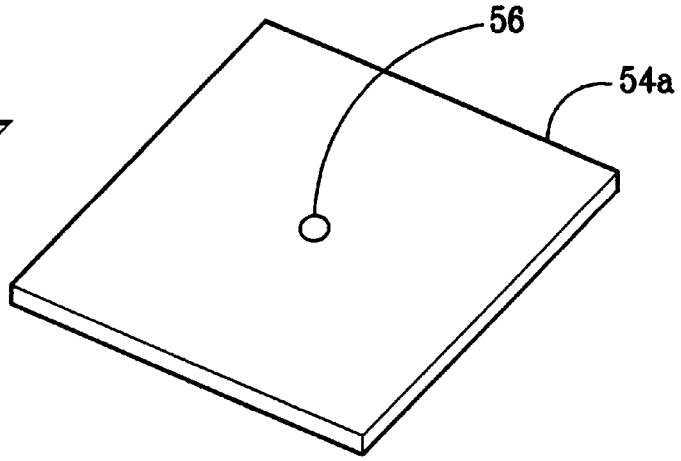
FIG. 7 is a view of an individual clamping plate.

A typical clamping plate is illustrated in FIG. 7 and is preferably four inches by four inches by one-quarter inch thick made of a rigid polyvinylchloride plastic. Clamping plate 54*a* has a central opening 56. A hex head stainless steel fastener 60 is inserted through the central opening of lower clamping plate 54*b* as viewed in FIG. 8, and through the central opening in upper clamping plate 54*a*. A self locking hex head stainless steel nut 62 is connected to the outer end of the bolt. The two clamping plates, the nut and the bolt are then inserted in the various locations indicated in FIG. 6 for holding the foam panels together. The clamping arrangement is adjustable to insure a tight fit each year.

Figure 10:
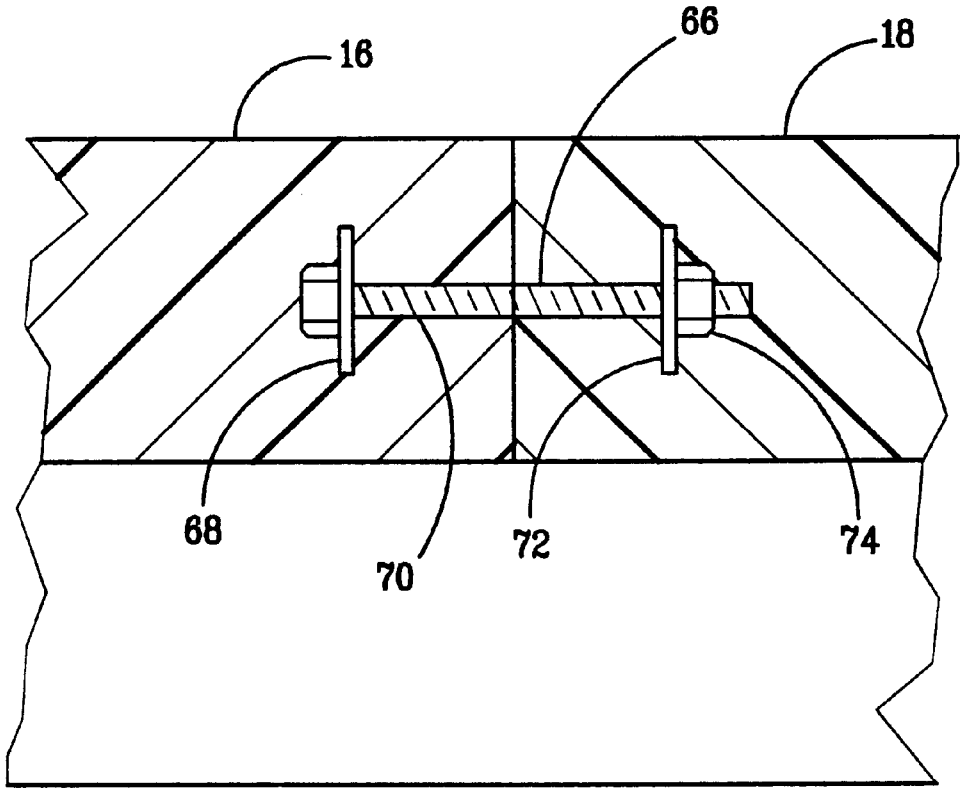
FIG. 10 illustrates another clamping device.

Referring to FIGS. 2, 3, and 6, four smaller clamping devices 66 are located at locations 50*i*, 50*j*, 50*k* and 50*l*. FIG. 10 shows a typical clamping device 66 which comprises a four inch long bolt 70 connecting a pair of two inch square plastic plates 68 and 72. The two plates are imbedded .in their respective panels 16 and 18 in a parallel position to connect the ends of the abutting surfaces.

I have described an improved floating platform which, although it can be formed of a greater number of panels, basically comprises four panels formed into an upper panel layer, and a lower panel layer which are clamped together in the center of the platform and also along the outer side edges. The platform can be easily disassembled for storage or for transport to another location.

Having described my invention, I claim:

1. A floating platform for bathing purposes, comprising;

a top panel layer having upper and lower parallel surfaces and formed of a permanently buoyant plastic foam material;

a bottom panel layer having upper and lower parallel surfaces and formed of a permanently buoyant foam material, the upper surface thereof being disposed in face-to-face relationship with the bottom surface of the upper panel layer;

means for joining the top panel layer to the bottom panel layer including;

a first rigid clamping plate imbedded in the top panel layer parallel to the upper and lower surfaces thereof;

a second rigid clamping plate disposed adjacent the lower surface of the bottom panel layer, parallel to the first clamping plate;

threaded means carried on the first clamping plate;

the second clamping plate having a fastener-receiving opening aligned with the threaded means on the first clamping plate; and an elongated eye bolt having threaded means on one end thereof engaged with the threaded means on the first clamping plate, and an eye, larger than the fastener-receiving opening in the second clamping plate, and disposed on the opposite side of the second clamping plate as the first clamping plate such that by turning the eye bolt, the first plate is biased toward the second plate to clamp portions of the top panel layer and the bottom panel layer together.

2. A floating platform as defined in claim 1, in which the threaded means on the first clamping plate comprises a nut fastened to the first clamping plate for engaging the eye bolt.

3. A floating platform as defined in claim 1, in which the top panel layer comprises a pair of similarly shaped panels, each of said pair of panels having an upper surface, a lower surface and a side surface, the side surfaces of each of said pair of panels abutting the side surface of a second of the pair of panels with the respective upper surfaces of each of said pairs of panels being disposed in a coplanar relationship, the side surfaces of the panels of the top panel layer having aligned clamping plate-receiving openings; and said first clamping plate having portions thereof disposed in said plate-receiving openings, and the eye bolt having a threaded end thereof connected to the first clamping plate and extending between the panels of the bottom panel layer to the second clamping plate.

4. A floating platform for bathing purposes comprising:

a top panel layer having upper and lower parallel surfaces formed of a permanently buoyant plastic foam material;

a bottom panel layer having upper and lower parallel surfaces and also formed of a permanently buoyant foam material, the upper surface thereof being disposed in face-to-face relationship with the bottom surface of the upper panel layer;

the top panel layer comprising a pair of similarly-shaped elongated panels, each of said pair of panels having a lower surface and a side surface, the side surfaces of each of said pair of panels abutting the side surface of the second of the pair of panels with respective upper surfaces of each of said pairs of panels being disposed in a coplanar relationship;

the bottom panel layer comprising a second pair of similarly-shaped panels, each of the second pair of panels having an upper surface in abutment with the lower surfaces of the panels of the top panel layer, and a side surface in abutment with the side surface of the other of the second pair of panels in a plane at right angles to the abutting side surfaces of the top panel layer;

means for joining the top panel layer to the bottom panel layer including;

a first rigid clamping plate imbedded in the top Panel layer parallel to the upper and lower surfaces thereof;

a second rigid clamping plate disposed adjacent the lower surface of the bottom panel layer, parallel to the first clamping plate;

threaded means carried on the first clamping plate;

the second clamping plate having a fastener-receiving opening aligned with the threaded means on the first clamping plate;

an elongated eye bolt having threaded means on one end thereof engaged with the threaded means on the first clamping plate, and an eye, larger than the fastener-receiving opening in the second clamping plate, disposed on the opposite side of the second clamping plate as the firs plate such that by turning the eye bolt, the first plate is biased toward the second plate to clamp portions of the top panel layer and the bottom panel layer together; and clamping means for separably joining the top panel layer to the bottom panel layer.

5. A floating platform as defined in claim 4, in which each of the panels has a rectangular configuration.

6. A floating platform as defined in claim 4, which the panels in the top and bottom panel layers are identical in shape.

7. A floating platform for bathing purposes, comprising:

a top panel layer having upper and lower parallel surfaces and formed of a permanently buoyant plastic foam material;

a bottom panel layer having upper and lower parallel surfaces and formed of a permanently buoyant foam material, the upper surface thereof being disposed in face-to-face relationship with the bottom surface of the upper panel layer;

means for joining the top panel layer to the bottom panel layer including:

each of the panels having a slot in the side edges of a pair of adjacent panels, the slots being disposed with the slot in a first panel of each of said pair of panels proximate the slot of a second panel;

a first clamping plate disposed in the slot of the first panel, parallel to the upper surface, and a second clamping plate disposed in a slot of a second panel, parallel to the first clamping plate such that a portion of each of said first and second panels is disposed between the first and second clamping plates; and a threaded fastener disposed generally at right angles and between the first and second clamping plates, the fastener having a first end connected to the first clamping plate, and a second threaded end connected to the second clamping plate for adjusting the distance between first and second clamping plates to clamp the portions of the first and second panels therebetween.

8. A floating platform as defined in claim 7, in which the fastener has a head engaging the first clamping plate, and the second panel has a opening for receiving the threaded end of the fastener, and a nut threadably mounted on the second end thereof such that by rotating the nut, the distance between the clamping plates can be adjusted.

9. A floating platform as defined in claim 8, including a cover enclosing the outer edges of all the connected panels fitting back around the invention.

* * * * *